US006635838B1

(12) United States Patent
Kornelson

(10) Patent No.: US 6,635,838 B1
(45) Date of Patent: Oct. 21, 2003

(54) SWITCH ACTUATING DEVICE AND METHOD OF MOUNTING SAME

(76) Inventor: Brent A. Kornelson, #4 - 1413 McGill Road, Kamloops, British Columbia (CA), V2C 6K7

( * ) Notice: Subject to any disclaimer, the term of this patent is extended or adjusted under 35 U.S.C. 154(b) by 0 days.

(21) Appl. No.: 10/176,607

(22) Filed: Jun. 24, 2002

(51) Int. Cl.[7] ..... H01H 3/12
(52) U.S. Cl. ..... 200/341; 200/302.2
(58) Field of Search ..... 200/341, 330, 200/302.2, 512–517

(56) References Cited

U.S. PATENT DOCUMENTS 4,088,855 A * 5/1978 Emery ..... 200/16 A
4,237,351 A 12/1980 Boulanger et al.
4,323,740 A 4/1982 Balash
4,471,189 A 9/1984 Bacon et al.
4,499,343 A 2/1985 Prioux et al.
4,794,215 A * 12/1988 Sawada et al. ..... 200/512
4,843,197 A * 6/1989 Kojima et al. ..... 200/406
5,258,592 A * 11/1993 Nishikawa et al. ..... 200/302.2
5,340,955 A 8/1994 Calvillo et al.
5,362,934 A * 11/1994 Inagaki et al. ..... 200/520
5,475,192 A 12/1995 Inagaki et al.
5,807,002 A * 9/1998 Tsai ..... 400/494

FOREIGN PATENT DOCUMENTS

JP 4169015 * 6/1992

* cited by examiner

*Primary Examiner*—Elvin Enad
*Assistant Examiner*—Lisa N Klaus
(74) *Attorney, Agent, or Firm*—Anthony C. Edwards

(57) ABSTRACT

A switch actuator includes a separate cap and connector which are assembled through an aperture formed in a resilient membrane which provides a switch cover. The resilient membrane has an exposed exterior surface and an opposite interior surface. The membrane is mountable, by gluing or the like of the interior surface to a switch plate having one or more pressure actuated electrical switches mounted thereto. The switch cover has one or more button-receiving apertures. A portion of the membrane immediately surrounding the button receiving apertures may be outwardly deformed as a circular frusto-conical dome.

5 Claims, 5 Drawing Sheets

Fig 1
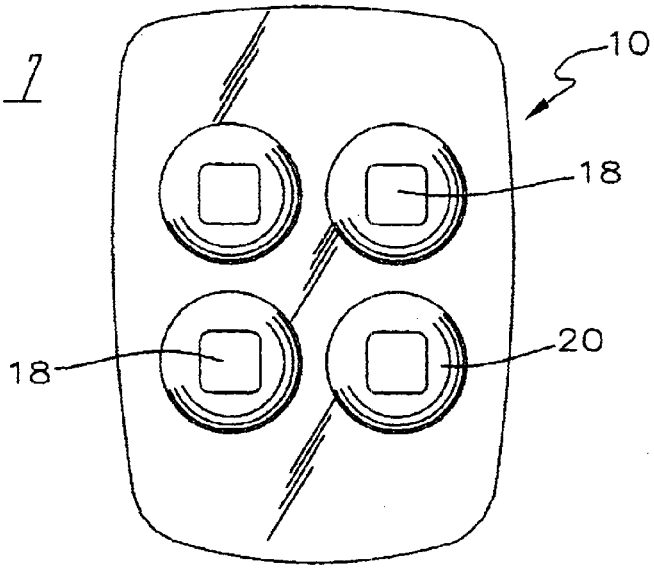
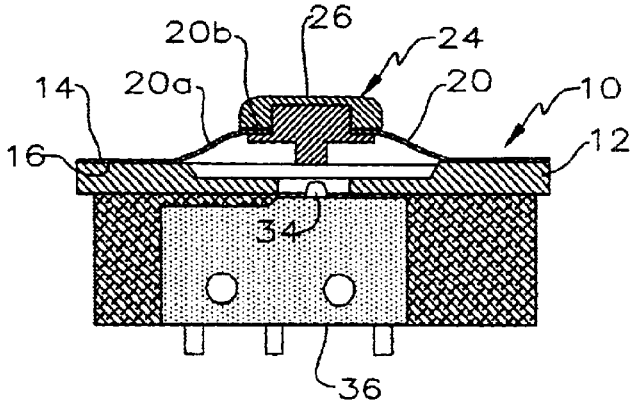
Fig 2
Fig 3
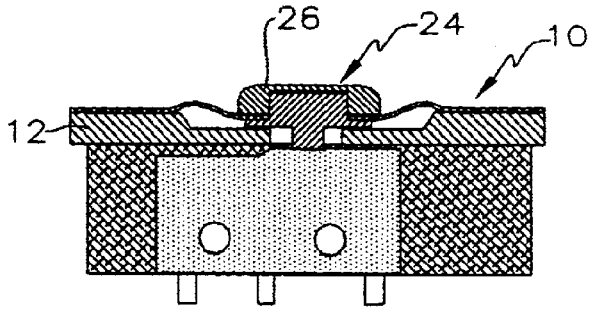

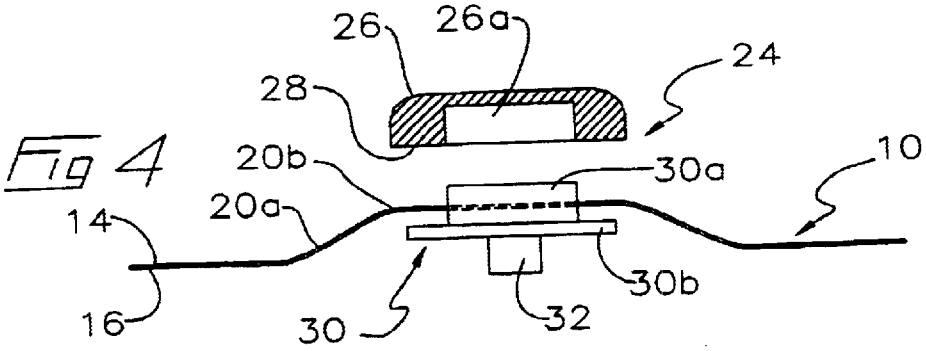
Fig 4
Fig 5
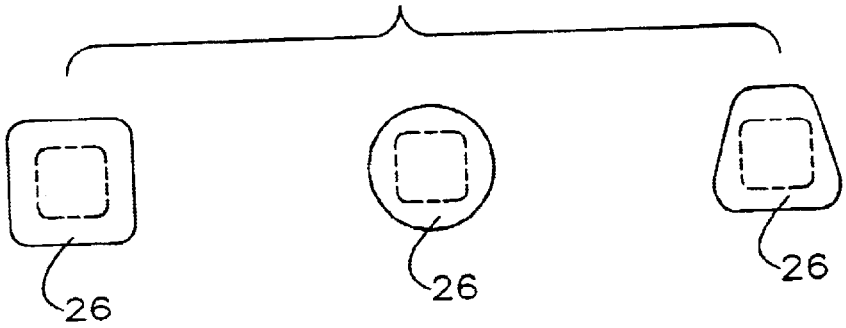
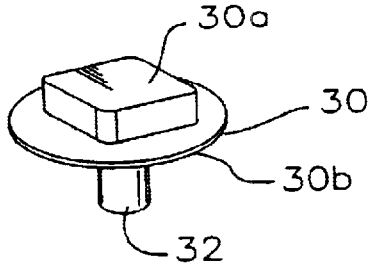
Fig 6

Fig 12
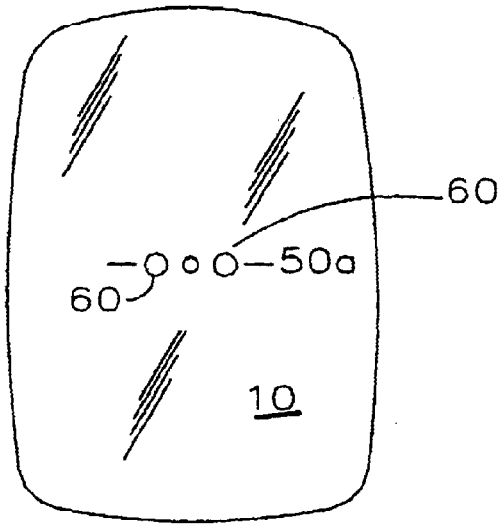
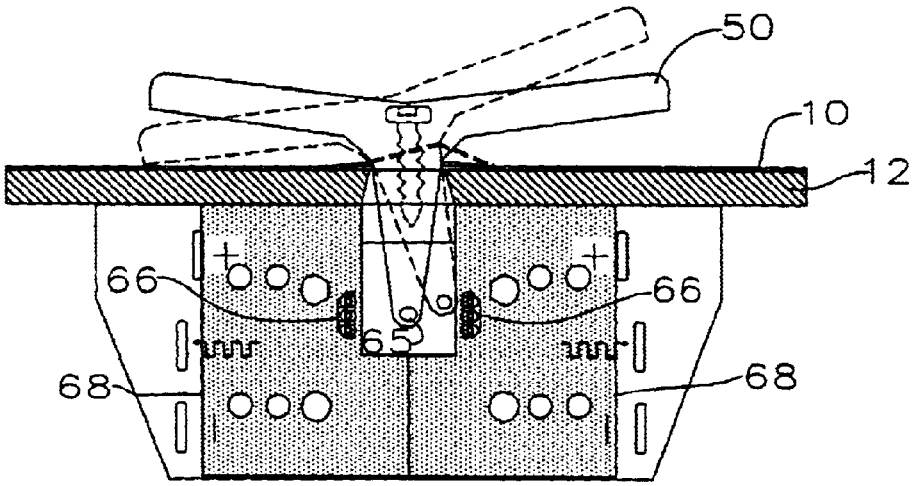
Fig 13

SWITCH ACTUATING DEVICE AND METHOD OF MOUNTING SAME

FIELD OF THE INVENTION

This invention relates to the field of switch actuators, and in particular to a membrane-mountable switch actuating device and to a method of mounting same to a membrane over a switch.

BACKGROUND OF THE INVENTION

It is well known in the art to cover one or more pressure switches positioned upon a switch plate with a resilient cover. By applying manual pressure on the resilient cover directly over the switch, the resilient cover is depressed to actuate the underlying switch. Further, in the prior art a portion of the membrane switch cover surrounding the pressure switch may have been outwardly deformed from the adjacent exterior surface of the membrane as a raised convex or frusto-conical dome.

In applicant's U.S. Pat. No. 6,064,019 a resilient membrane cover for electrical switch plates has one or more switch actuator buttons welded thereto. The head of the button projects above the exterior membrane surface. A switch actuation plunger, surrounded by a deformable annular sleeve depending at right angles from the head, projects outwardly of the inner surface of the membrane through an aperture. A circular portion of the upper surface of the membrane, generally surrounding the plunger, is subjected to heat and pressure to create a raised pillow-shaped embossed area. Heat and pressure are applied to the deformable sleeve to secure the button and membrane together, as by riveting.

The switch plate generally has a depression corresponding to the circular deformed area of the membrane, permitting the circular raised portion of the membrane to be slightly depressed during switch actuation and, when released, to return the button to a non-depressed position.

It has been found that the current method of riveting an actuator button with an integral deformable sleeve to the resilient membrane, by applying heat, in a temperature range of 120 degrees Celsius to 300 degrees Celsius with sufficient pressure to the deformable sleeve generally against the underside of the circular domed portion of the cover membrane, tends to shrink the raised portion of the membrane with a resultant decrease in its height. The inherent resilient property of the polyester or like material still allows the button to be returned to non-depressed position after use.

Further, after time, it has been found that where the cross sectional shape of the deformable sleeve and the aperture in the membrane are circular, the button will loosen and the button will tend to rotate out of position. Also, when the button loosens the rotation may cause the polyester cover to quickly cut into the shaft of the button. Preventing rotation helps to prevent this. Further such out-of-position rotation may tend to render buttons formed as pictograms or with international symbols more difficult for the user to understand or they may become meaningless to the user.

SUMMARY OF THE INVENTION

The switch actuator of the present invention comprises a separate cap and connector which are assembled through an aperture formed in a resilient membrane which provides a switch cover. The resilient membrane has an exposed exterior surface and an opposite interior surface. The membrane is mountable, by gluing or the like of the interior surface to a switch plate having one or more pressure actuated electrical switches mounted thereto. The switch cover has one or more non-circular button-receiving apertures. A portion of the membrane immediately surrounding the button receiving apertures may be outwardly deformed as a circular frusto-conical dome. In a further aspect the dome may be a separate component adapted to be non-rotationally received within an aperture formed in the switch cover.

A switch actuator is positioned within each button-receiving aperture formed in the switch cover. The actuator has a cap, which may be formed as a pictogram, for example a polygon containing three sides, which represents a directional arrow. The cap of the actuator is centered over the aperture formed in the membrane and contains a recess on its underside. A connector having an upstanding head conformably shaped to the cap recess and membrane aperture is insertable through the membrane aperture to be secured within the recess on the underside of the cap.

In a further aspect, the switch actuator may be a toggle type switch actuator, where an accessible elongated cap contains a projecting head, formed medially on its underside. One or more positioning pins depend from the underside of the head and are adapted to be inserted through similarly shaped apertures formed in the flexible membrane switch cover to extend into recesses formed in the switch. A connector positioned adjacent the interior surface of the cover is secured to the cap by means of a suitable fastening means such as adhesive or screws to firmly retain between them a portion of the cover.

In summary, the switch actuating device of the present invention includes a base plate, a flexible cover and a switch actuator. The base plate has at least one aperture therethrough. The flexible cover is mounted onto the base plate so as to cover over the aperture in the base plate. The cover has at least one aperture therethrough. The aperture or plurality of apertures in the cover each overlie or are aligned with, so as to be coextensive with, the apertures in the baseplate. As used herein, reference to first apertures is a reference to apertures in the baseplate. Reference to second apertures is a reference to apertures in the cover.

A switch actuator is rigidly mounted to the flexible cover so as to be journalled at least partially through the first aperture and through the second aperture, one actuator per first aperture. The switch actuator includes a cap and a base. The cap and the base are disposed on opposite sides of the cover. The cap and the base are mounted to one another so as to sandwich the cover between the cap and the base. The second aperture is formed as a socket means for mating with a corresponding plug means between the cap and the base for inhibiting rotation of the switch actuator relative to the cover in a plane substantially parallel to the cover.

In one embodiment, the plug means includes a non-cylindrical shaft extending between the cap and the base and the socket means is the second aperture when sized to fit snugly around the shaft and shaped to correspond in shape to the shaft. The shaft is a plunger generally perpendicular to the cover for translation orthogonally to the cover so as to actuate a switch mounted to the base plate on an opposite side of the base plate to the cover. The cap may include a cavity for receiving the shaft in mating engagement therein, wherein the cavity is shaped to correspond in shape and size to the second aperture. The base may include a flange for extending around the shaft so as to sandwich the cover under the cap. The cap is shaped so as to provide an opposed facing bearing surface to the flange when sandwiching the cover.

The cover may be a flexible membrane and formed as a resilient dome concentrically around the first and second apertures. Alternatively a resilient dome member may be mounted between the cap and the cover concentrically around the first and second apertures.

In a further embodiment, the plug means includes a spaced apart pair of shafts and the socket means a corresponding pair of second apertures. The pair of shafts are sized for snug mating journalled through the pair of the second apertures. The pair of shafts are mounted in the pair of second apertures so as to sandwich the cover therebetween to provide a hinge for rotation of the cap in a rocker motion about the hinge.

The base may extend through the first aperture into proximity to a switch mounted to the base plate on an opposite side of the base plate to the cover.

The cap may be elongate in a direction perpendicular to a hinge line of the hinge. Again, the cover may be a flexible membrane. The pair of shafts may be parallel and rigidly mounted to the cap.

In the method of mounting a switch actuating device according to the present invention the method includes the steps of providing the above described device, aligning the plug means with the at least one second aperture and journaling the plug means through the at least one second aperture so as to mate the cap to the base and sandwich the cover therebetween.

BRIEF DESCRIPTION OF THE DRAWINGS

FIG. 1, is a plan view of the resilient switch cover membrane.

FIG. 2 is a sectional view through the switch plate with the actuator in the elevated position.

FIG. 3 is a sectional view through the switch plate showing the button in the depressed position.

FIG. 4 is an exploded sectional view through the switch actuator.

FIG. 5 is a plan view illustrating several alternative cap shapes.

FIG. 6 is as an isometric view of a typical connector.

FIG. 12 is a plan view of an alternative switch cover membrane containing apertures for a toggle switch.

FIG. 13 is a cross sectional view through a switch plate with a toggle switch attached.

DETAILED DESCRIPTION OF EMBODIMENTS OF THE INVENTION

Figure 7:
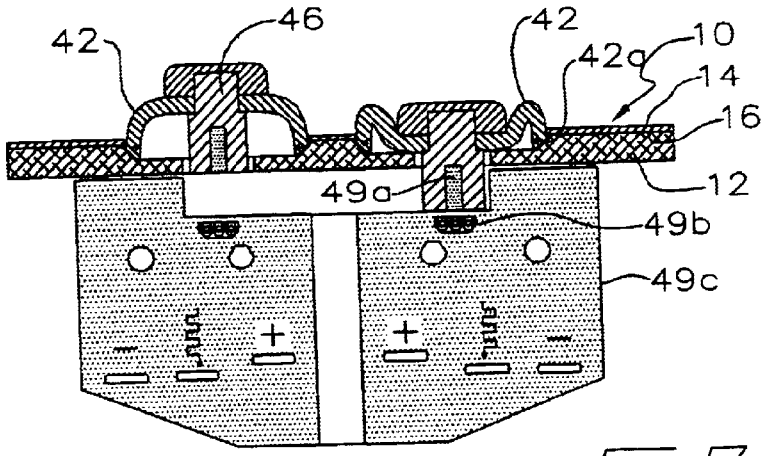
FIG. 7 is a sectional view through a switch plate containing a switch cover having a separate domed area to which a switch actuator is affixed.

With reference to the FIGS. 1–13, it is understood that similar characters of reference denote corresponding parts in each view.

Switch cover membrane 10 is a thin resilient membrane, for example polyester, which may be readily trimmed to fit a switch plate 12. Cover 10 is bonded to plate 12 by adhesive or the like means known in the art. Switch cover membrane 10 has an exterior and an opposite interior surface 14 and 16 respectively. One or more non-circular apertures 18 are formed through cover 10. Domes 20 are formed on cover membrane 10, centered on each aperture 18. Each dome projects outwardly from exterior surface 14. Each dome may be in cross section, frusto-conically shaped. Thus dome 20 has, when viewed in cross section as illustrated in FIG. 4, sloping side walls 20*a* and a flat top 20*b*. Aperture 18 is generally centered on flat top 20*b*.

Switch actuators 24 are mounted within apertures 18. Each actuator 24 has a cap 26 which mounts adjacent exterior surface 14. Cap 26 has a recess 26*a* formed on its underside 28. Recess 26*a* is aligned with aperture 18. A connector plate 30 has an upstanding non-round head 30*a* Head 30*a* is non-circular and corresponds to the shape and size of the perimeter of aperture 18. Thus with head 30 snugly mounted in aperture 18, plate 30 is retained against rotation relative to membrane 10. Connector plate 30 has a perimeter flange 30*b*, which, in plan view, conforms to the shape of the footprint of cap 26 when mounted onto plate 30. With head 30*a* fully inserted through aperture 18, flange 30*b* forms a shoulder, which contacts the underside 16 of membrane 10 so as to sandwich the membrane between the plate and cap.

An actuator shaft 32 extends at right angles from the center of perimeter flange 30*b*, oppositely disposed relative to head 30*a*. When actuator 24 is depressed, shaft 32 is brought into biasing contact with the actuation plunger 34 of an electrical switch 36 as seen in 25 FIGS. 2 and 3. As may be seen illustrated in FIG. 5, caps 26 may for example be a three or four-sided polygon or a circular shape.

Figure 7A:
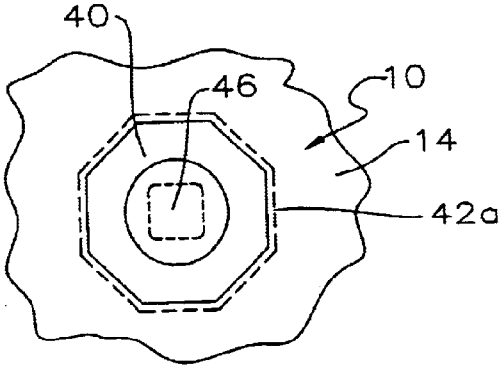
FIG. 7*a* is a partial plan view of the actuator depicted in FIG. 7.
Figure 8:
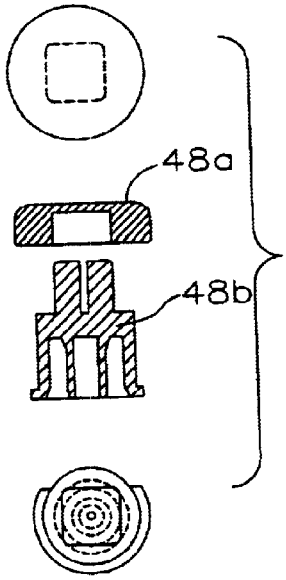
FIG. 8 is a sectional view illustrating the component parts of the switch actuator of FIG. 7.
Figure 9:
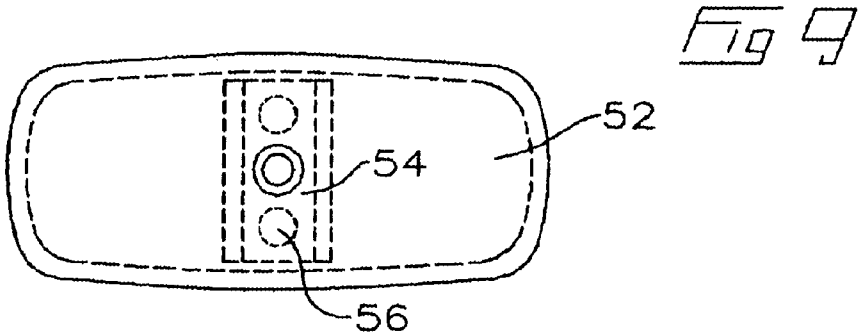
FIG. 9 is a plan view of the toggle switch cap.
Figure 10:
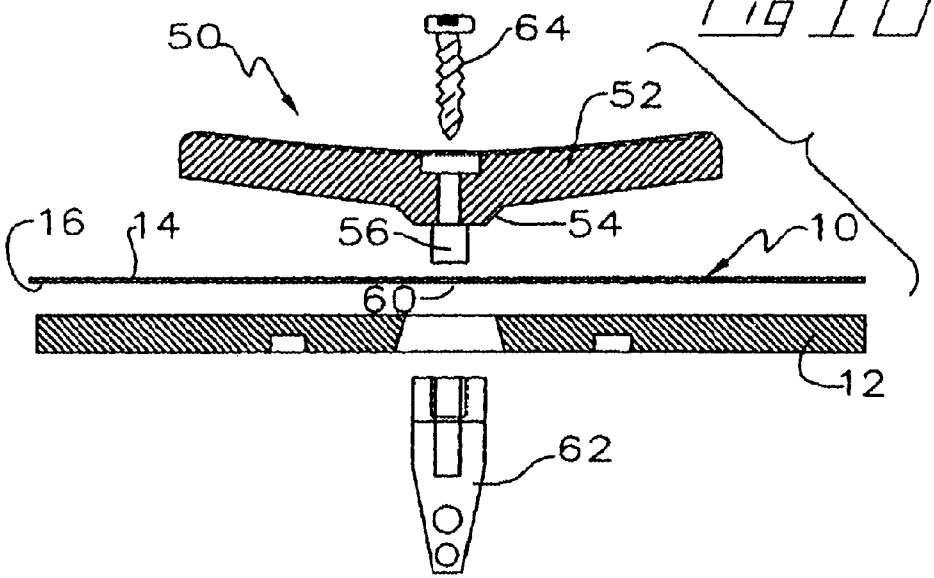
FIG. 10 is an exploded sectional view of the toggle switch.
Figure 11:
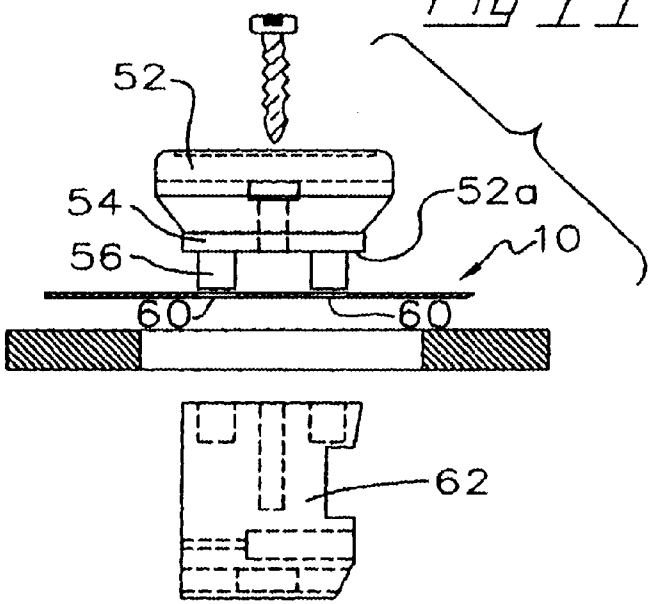
FIG. 11 is a side elevation, partially in section of the switch of FIG. 10.

FIGS. 7 and 7*a* depict a switch cover membrane 10 having non-circular aperture 40 formed therein. A separate flexible actuator dome 42 is mounted into aperture 40. Dome 42 has a laterally projecting perimeter flange 42*a* which extends slightly under the perimeter of aperture 40, thereby sandwiching flange 42*a* between switch cover membrane 10 and a corresponding depression or annular seat in switch plate 12. A non-round aperture 46 is formed in the apex of raised dome 42 through which a two-piece switch actuator is mounted. Flexible dome 42 is resilient so that once depressed, that is deformed, and released the dome returns to its non-deformed shape without elastic hysteresis. Thus dome 42 may be thought of as retaining a shape in memory which causes the dome to return to its non-deformed state upon release of downward pressure on the switch actuator. The two piece switch actuator may, in a manner similar to switch actuator 24, have a cap 48*a* and a base 48*b*. Cap 48*a* mounts onto a non-round upper end of the base protruding snugly through aperture 46. The lower end of the base may have cavities in which may be mounted, for example, small magnets 49*a* cooperating with magnetic field proximity sensors 49*b* on circuit boards 49*c* thereby allowing for example variable speed control.

The flexible switch cover membrane 10 may also be used with toggle-type switches 50 as illustrated in FIGS. 9 through 13. An elongated for example rectangular shaped cap 52 has a medial head 54. Positioning pins 56 depend from the underside 52*a* Pins 56 mate with a pair of laterally aligned apertures 60 formed in switch cover membrane 10 to prevent rotation of the cap in the plane of the membrane so as to prevent misalignment of both the cap and, as before, any symbols presented on the upper surface of the cap. Base 62 mounts onto the pins so as to sandwich membrane 10 therebetweeL Cap 52 and base 62 may be securely fastened together by a screw 64 to firmly retain between them a portion of switch cover membrane 10. The portion of membrane 10 clamped between cap 52 and base 62 acts as a flexible hinge pivot allowing rotation of switch 50 in a rocker motion about the hinge or pivot line 50*a* defined by and between the.pins for the rocker operation of the toggle switch. As seen in FIG. 13, the rocker motion of switch 50 lifts and bends membrane 10 in the adjacent area surrounding the portion of membrane 10 clamped between the cap and base. This adjacent area is best then not glued down onto, or otherwise affixed to base plate 12. As before, the lower end of the switch may house a magnet 65 so that the magnet is rotated in and out of proximity to magnetic field sensors 66 on circuit boards 68.

As will be apparent to those skilled in the art in the light of the foregoing disclosure, many alterations and modifications are possible in the practice of this invention without departing from the spirit or scope thereof Accordingly, the scope of the invention is to be construed in accordance with the substance defined by the following claims.

What is claimed is:

1. A switch actuating device comprising:

a base plate having a first aperture therethrough, a flexible cover mounted onto said base plate so as to cover over said first aperture in said base plate, said cover having a second aperture therethrough said second aperture aligned so as to be coextensive with said first aperture, a switch actuator rigidly mounted to said flexible cover so as to be journalled through said first aperture and said second aperture wherein said switch actuator includes a cap and a base, said cap and said base disposed on opposite sides of said cover, said cap and said base mounted to one another so as to sandwich said cover between sad cap and said base, wherein said second aperture is formed as a socket means for mating with a corresponding plug means between said cap and said base for inhibiting rotation of said switch actuator relative to said cover in a plane parallel to said cover, wherein said plug means includes a spaced apart pair of shafts and wherein said socket means is a corresponding pair of said second apertures, said pair of shafts sized for snug mating journalled through said pair of said second apertures, wherein said pair of shafts mounted in said pair of said second apertures sandwich said cover therebetween to provide a hinge for rotation of said cap in a rocker motion about said hinge.

2. The device of claim 1 wherein said base extends through said first aperture into proximity to a switch mounted to said base plate on an opposite side of said base plate to said cover.

3. The device of claim 2 wherein said cap is elongate in a direction perpendicular to a hinge line of said hinge.

4. The device of claim 2 wherein said cover is a flexible membrane.

5. The device of claim 1 wherein said pair of shafts are parallel and rigidly mounted to said cap.

* * * * *